United States Patent [19]

Fujisawa et al.

[11] Patent Number: 4,472,949

[45] Date of Patent: Sep. 25, 1984

[54] OIL SEPARATOR

[75] Inventors: Hidehiko Fujisawa; Kenji Ishizaka, both of Tokyo, Japan

[73] Assignee: Clarion Co., Ltd., Tokyo, Japan

[21] Appl. No.: 479,486

[22] Filed: Mar. 28, 1983

[30] Foreign Application Priority Data

Mar. 26, 1982 [JP] Japan ..... 57-49920

[51] Int. Cl.[3] ..... F25B 43/02

[52] U.S. Cl. ..... 62/473; 62/468

[58] Field of Search ..... 62/470, 473, 503, 509, 62/512, 527, 84, 468

[56] References Cited

U.S. PATENT DOCUMENTS

| | | | |
|---|---|---|---|
| 3,304,697 | 2/1967 | Ramsey | 62/473 |
| 3,324,680 | 6/1967 | Cremer | 62/473 |
| 4,202,182 | 5/1980 | Kawashima et al. | 62/527 |

*Primary Examiner*—Ronald C. Capossela

*Attorney, Agent, or Firm*—Russell E. Hattis

[57] ABSTRACT

In a refrigeration system comprising a compressor, an oil separator, a condenser, an expansion valve, an evaporator, etc., a groove for oil separation is provided along inner wall of a refrigerant gas supply pipe which connects the oil separator and the compressor, and an oil reservoir is provided at the bottom of the oil separator.

6 Claims, 4 Drawing Figures

OIL SEPARATOR

BACKGROUND OF THE INVENTION

This invention relates to an oil separator to improve cooling efficiency of a refrigeration system.

Refrigerant which flows in a refrigeration system of an air conditioner comes to include more and more oil as circulating in the system. Oil increases circulation resistance of refrigerant and decreases heat-transfer coefficient and cooling efficiency. Therefore, oil must be separated from refrigerant.

One of the prior-art methods to separate oil is to dash refrigerant discharged from a compressor against a metallic mesh provided within a discharge pipe so that the oil adheres to the mesh and does not pass therethrough. Another prior-art method is to make discharged gas whirl so as to strike an inner wall of a discharge pipe so that the oil adheres to the wall.

However, those prior-art methods cannot sufficiently improve heat-transfer coefficient of refrigeration system because gas pressure is lowered when refrigerant strikes metal mesh or pipe wall.

OBJECT OF THE INVENTION

It is therefore an object of the present invention to overcome the above-mentioned drawback involved in the prior art and to provide an oil separator arranged to easily separate oil from refrigerant without causing loss of refrigerant gas pressure.

SUMMARY OF THE INVENTION

In accordance with the present invention, a groove is provided along inner periphery of a refrigerant gas supply pipe for facilitating oil separation and an oil reservoir is provided at the bottom of an oil separation room.

DETAILED DESCRIPTION OF THE PREFERRED EMBODIMENTS

Figure 1:
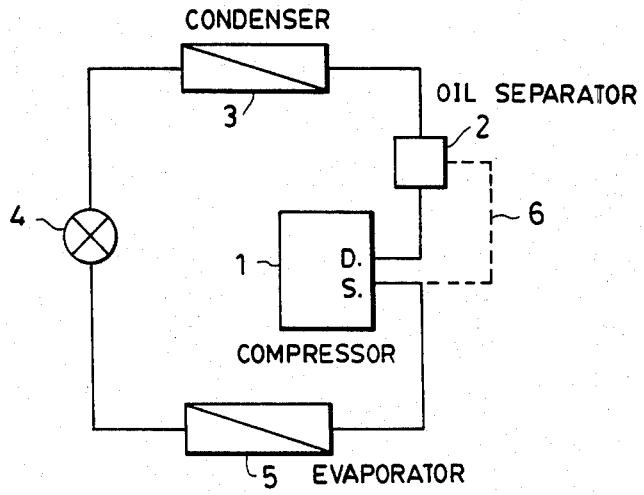
FIG. 1 is a block diagram of a refrigeration system to adapt the oil separator according to the present invention thereto.

FIG. 1 shows a refrigeration system to adapt thereto the oil separator according to the present invention. Reference numeral 1 designates a compressor, 2 refers to an oil separator, 3 to a condenser, 4 to an expansion valve, 5 to an evaporator, and 6 to a release portion, respectively. The oil separator 2 is connected to discharge portion D and suction portion S of the compressor 1.

Figure 2:
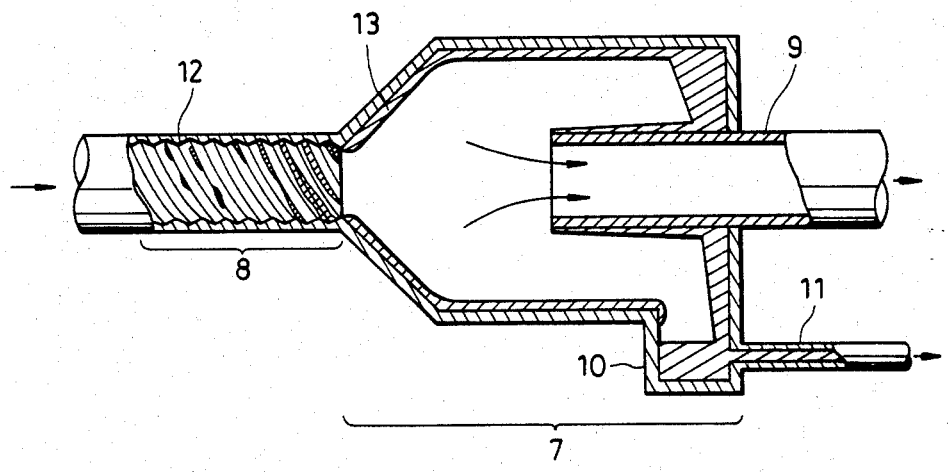
FIG. 2 is a sectional view of an embodiment of the oil separator according to the present invention.

FIG. 2 is a sectional view of an embodiment of the oil separator according to the present invention. Reference numeral 7 refers to an oil separation room or chamber wherein oil included in refrigerant gas is separated, 8 to a refrigerant gas supply pipe provided in a portion of the oil separation room 7, 9 to a refrigerant gas discharge pipe with its end projecting in another portion of the oil separation room 7, 10 to an oil reservoir or collection means provided at the bottom of the oil separation room 7, and 11 to a release pipe provided in the oil reservoir 10, respectively.

The refrigerant supply pipe 8 is connected to the discharge portion D of the compressor 1 and is provided along the inner periphery thereof with a groove 12. The refrigerant gas discharge pipe 9 is connected to the condenser 3. The release pipe 11 is connected to the suction portion S of the compressor 1. The release pipe 11 is not requisite and may be omitted.

As clearly shown in FIG. 2, groove 12 has a spiral configuration on the inner surface of refrigerant gas supply pipe 8 and each of the spiral configuration grooves defines a channel that terminates at the end of pipe 8 in chamber or oil separation room 7. Also, the inner end of refrigerant gas discharge pipe 9 terminates within chamber 7 at a location spaced from the wall of the chamber to thus define an inlet opening into discharge pipe which is located generally centrally of chamber 7.

With this arrangement, refrigerant gas discharged from the discharge portion D of the compressor 1 to the refrigerant gas supply pipe 8 is supplied to the oil separation room 7 through the groove 12. While the refrigerant gas passes through the groove 12, centrifugal force is caused so that oil particles with heavier gravity adhere to the base of the groove 12. The centrifugal force will maintain the oil 13 in the base of the groove and will cause it to flow along the spiral configuration of the groove 12 to the oil separation room 7 and further flows along the wall of the oil separation room 7 to the oil reservoir 10. When the oil 13 exceeds a predetermined amount in the oil reservoir 10, the excessive oil is transported to the suction portion S of the compressor 1 due to pressure difference between the suction portion S and the discharge portion D of the compressor 1. On the other hand, the refrigerant gas which reached the oil separation room 7 is transported to the condenser 3 through the refrigerant gas discharge pipe 9. Since the inlet to discharge pipe 11 is spaced from the wall of oil separation room, there is no possibility of the oil adhered to the wall flowing into the discharge pipe.

As described in the above, oil is separated from refrigerant gas immediately after the refrigerant gas is discharged from the compressor 1. Therefore, refrigerant gas which passes through the condenser 3 and the evaporator 5 includes almost no oil. As the result, gas circulation resistance decreases, heat-transfer is promoted and cooling efficiency of the air conditioner is improved.

Figure 3:
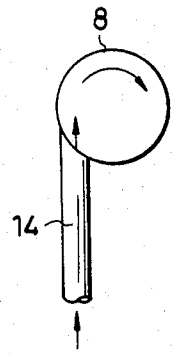
FIGS. 3 and 4 are schematic views illustrating other embodiments according to the present invention.

FIG. 3 shows another embodiment according to the present invention wherein the discharge pipe 14 from the discharge portion of the compressor 1 is eccentrically connected to the refrigerant gas supply pipe 8.

Figure 4:
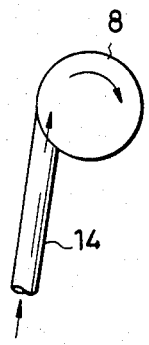

FIG. 4 is a further embodiment according to the present invention wherein the discharge pipe 14 from the discharge portion of the compressor 1 is disposed along a tangent of the refrigerant gas supply pipe 8.

Those two embodiments particularly cause whirl flow of refrigerant gs.

We claim:

1. An oil separator for a refrigeration system including a compressor, an oil separator, a condenser, an expansion valve, and an evaporator, said oil separator comprising: an oil separation room to separte oil from refrigerant gas circulating in said refrigeration system;

a refrigerant gas supply pipe connecting a discharge portion of said compressor to said oil separation room;

a refrigerant gas discharge pipe connecting said oil separation room to said condenser;

an oil reservoir provided at the bottom of said oil separation room; and means defining a groove along inner wall of said refrigerant gas supply pipe terminating in said oil separation room so that centrifugal forces will cause said oil to separate from said refrigerant gas and collect and flow in said groove to said oil separation room.

2. An oil separator as set forth in claim 1 further including a release pipe connecting said oil reservoir and suction portion of said compressor.

3. An oil separator as set forth in claim 1 or 2 further including an outlet pipe connecting said refrigerant gas supply pipe and said discharge portion of the compressor, said outlet pipe being disposed eccentrically of said refrigerant gas supply pipe.

4. An oil separator as set forth in claim 1 or 2 further including an outlet pipe connecting said refrigerant gas supply pipe and said discharge portion of the compressor, said outlet pipe being disposed along a tangent of said refrigerant gas supply pipe.

5. In an oil separator for use in a refrigeration system for separating oil from refrigerant gas between a compressor and a condenser comprising: means defining a chamber having a refrigerant gas supply pipe connecting a discharge portion of said compressor to said chamber, and a refrigerant gas discharge pipe leading from said chamber to said condenser, the improvement of means defining a spiral groove along an inner wall of said refrigerant gas supply pipe with said spiral groove terminating in said chamber so that centrifugal forces of the flowing refrigerant gas will cause oil to separate from the refrigerant gas and collect and flow along said spiral groove into said chamber; and collection means in said chamber for accumulating oil in said chamber.

6. An oil separator as defined in claim 5, in which said chamber has an inner wall leading to said collection means with said accumulated oil flowing along said inner wall to said collection means and said refrigerant discharge pipe has an inlet spaced from said inner wall to prevent accumulated oil in said chamber from flowing through said inlet.

* * * * *